United States Patent [19]

Thornburg et al.

[11] Patent Number: 4,710,756

[45] Date of Patent: Dec. 1, 1987

[54] COMBINATION SMOKE DETECTOR AND DEVICE FOR CONTAINING AIR

[76] Inventors: Dennis D. Thornburg, 6035 Alfredo Ave., Chino, Calif. 91710; Richard R. Parenteau, 23542 Belmar, Laguna Niguel, Calif. 92677

[21] Appl. No.: 689,068

[22] Filed: Jan. 7, 1985

[51] Int. Cl.[4] ..... G08B 17/10

[52] U.S. Cl. ..... 340/628; 2/202; 128/201.23; 128/202.13; 128/206.27; 244/118.5; 340/573

[58] Field of Search ..... 340/628, 573; 244/118.5; 128/202.13, 205.24, 205.25, 206.27, 201.23, 201.24; 2/202

[56] References Cited

U.S. PATENT DOCUMENTS

| | | | |
|---|---|---|---|
| 3,107,373 | 10/1963 | Mellon, Jr. et al. | 128/201.23 |
| 3,503,394 | 3/1970 | Hotz et al. | 128/206.27 |
| 3,981,302 | 9/1976 | Veit | 128/206.27 X |
| 4,154,237 | 5/1979 | Courter | 244/118.5 X |
| 4,394,861 | 7/1983 | Sciortino | 244/118.5 X |
| 4,463,896 | 8/1984 | Schaus | 98/1 X |
| 4,481,945 | 11/1984 | Levine | 244/118.5 X |
| 4,502,157 | 3/1985 | Wong | 2/202 |
| 4,550,856 | 11/1985 | Ballmann et al. | 128/202.13 X |

*Primary Examiner*—James L. Rowland
*Assistant Examiner*—Daniel Myer
*Attorney, Agent, or Firm*—Barry A. Bisson

[57] ABSTRACT

A combination smoke detector and one or more bags for containing air including a housing having a plurality of compartments, a smoke detector unit being mounted in one compartment and an air-bag member being stored in each of the remaining two contiguous compartments. The storage compartments are covered by a hinged panel that opens to release the bags which drop and hang freely from their respective compartments when the smoke detector is activated. Each air bag is arranged to receive and cover a wearer's head so as to provide breathable air during an escape to safety from a smoke-filled room or building.

9 Claims, 7 Drawing Figures

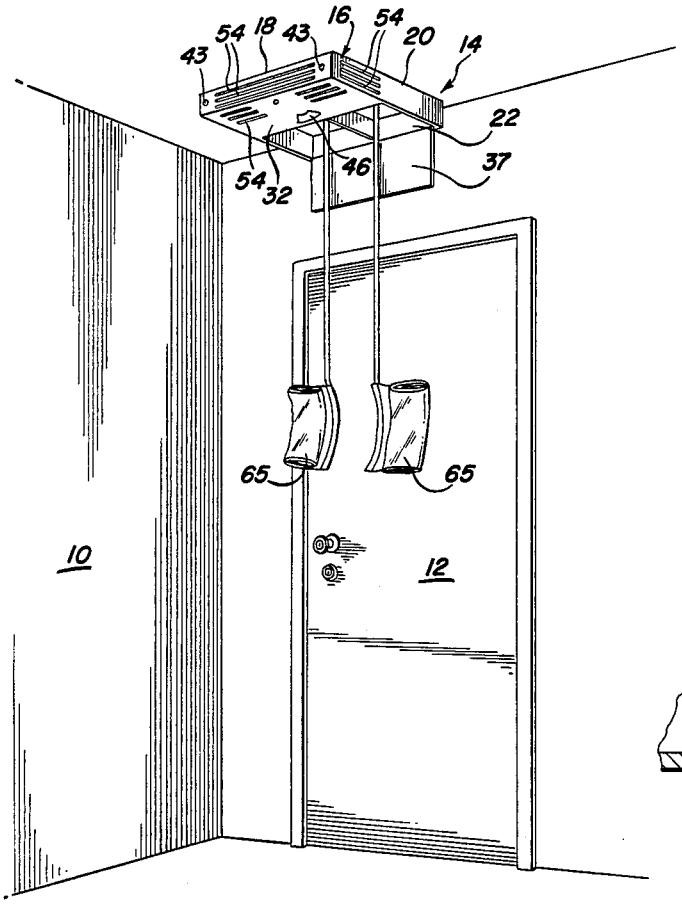
FIG. 1
FIG. 5
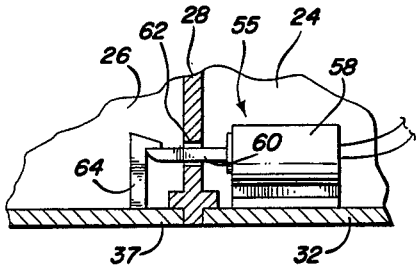
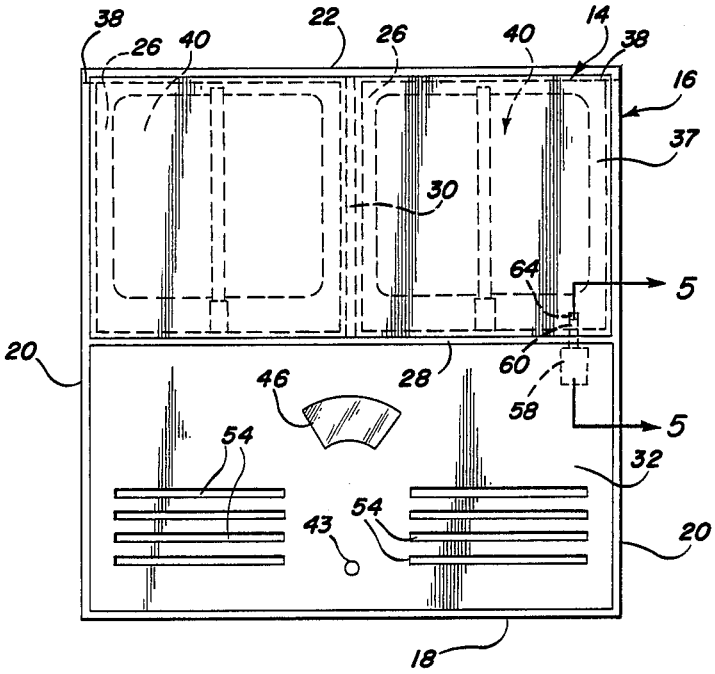
FIG. 2

FIG. 3
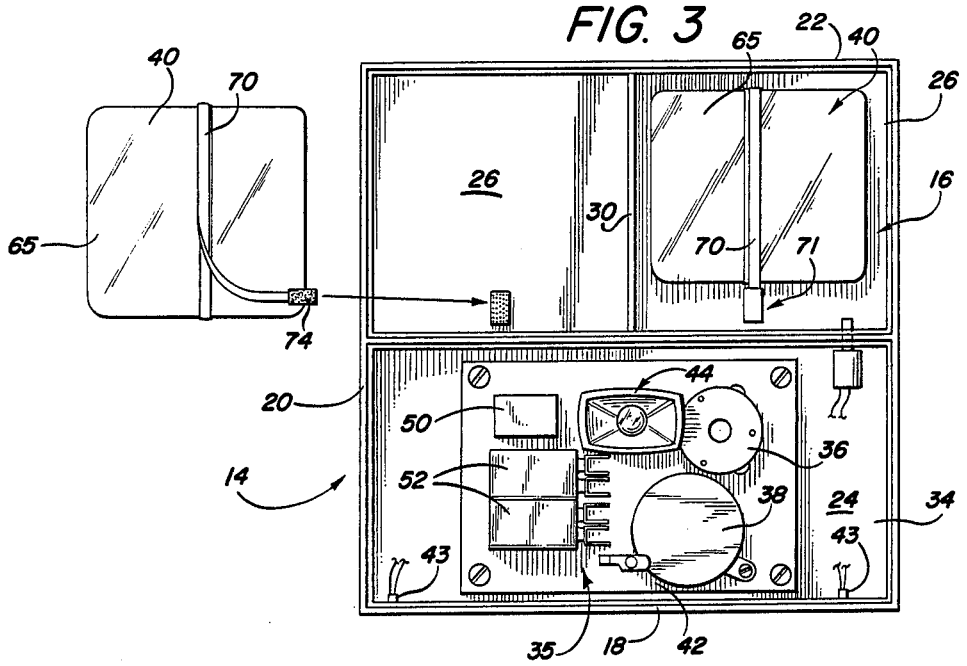
FIG. 4a
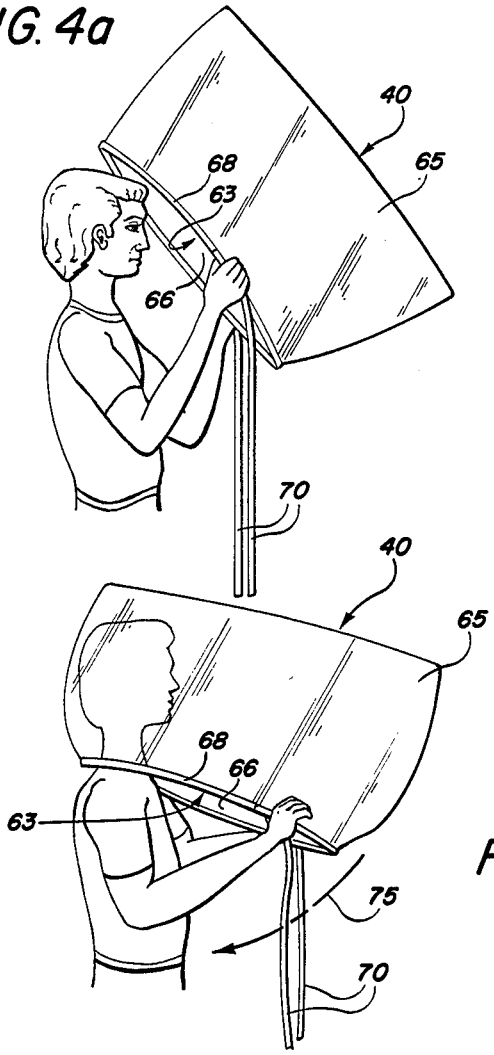
FIG. 4c
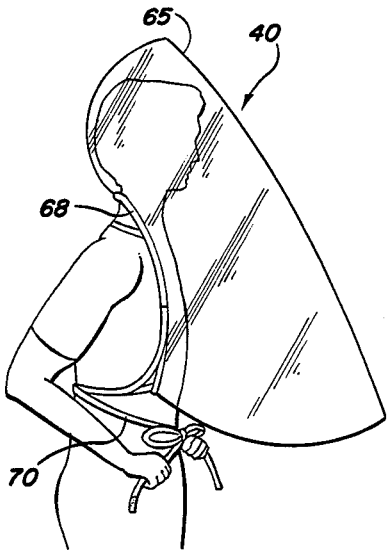
FIG. 4b

COMBINATION SMOKE DETECTOR AND DEVICE FOR CONTAINING AIR

BACKGROUND OF THE INVENTION

1. Field of the Invention

This invention relates to an emergency device for use during a building fire, and more particularly to a smoke detector for alerting occupants of a room in a multistory structure when fire breaks out, in combination with air bags which are automatically exposed to assist the occupants in escaping to safety while breathing clean air captured within the air bags.

2. Description of the Prior Art

It has become increasingly evident that, in spite of stricter building codes, there are still many problems and difficulties being encountered in providing fire-safe structures, particularly with respect to high-rise office and hotel buildings. It is well known that these buildings must be provided with fire protective means, such as alarm systems, sprinklers and emergency exits. However, very often an alarm system itself becomes inoperable during a fire and a sprinkler system might lack water pressure at the upper levels. This has been noted recently in each of several fires in high-rise buildings where many persons perished—not because of the fire itself but because there was a lack of emergency instructions and related equipment to prevent unnecessary harm to the exposed and/or trapped individuals.

As an example, the following is an analysis resulting from a fire emergency relating to a high-rise multistory hotel and the guests therein.

Preservation of the lives of hotel guests, especially in high-rise structures, rests upon three main factors—and, as an analogy, we will refer to these as the three legs of a tripod.

The first leg in the tripod is the structure of the building itself—the presence or absence of fire-impedance walls, amount and locations of flammable materials, alarm systems, sprinklers and emergency exits. The emergency training of the hotel staff is also included.

The second leg of the tripod is the quality of the local fire department. Both the quality and the amount of equipment, and the training and numbers of the firefighters are to be considered.

These first two factors are dealt with—and with varying degrees of effectiveness—by local building and safety codes, by the willingness of hotel owners to exceed code requirements, and by taxpayer support of the local fire department.

The third and most neglected leg of the tripod is the behavior of the hotel guest caught in such a fire. In a high-rise office building, fire drills can be imposed on a relatively stable number of employees who will at least be aware of the possiblity and have some idea of what to do, including how to exit the building. In a hotel, however, we are dealing with a constantly changing population of guests, most of whom are unaware of any potential danger, and the hotel management that is trying to make guest accommodations as pleasant as possible and do not go out of their way to make the guests aware of basic safety facts. Indeed, in some resort areas hotel management avoids even bringing up the spector of fire or other danger. Very often, there are also few or no fire extinguishers provided, there are minimally marked fire exits, and there are no emergency plans for guests which would allude to the possibility of danger.

In the tripod analogy, safety of the hotel guests rests on all three legs; and failure of anyone of those legs will almost certainly increase the possibility of guest injury or death. Firstly, if the fire department is of top quality and the guests are informed as to fire safety—but if the building is poorly constructed of flammable material, and with no safety features—a disaster is waiting to occur. Secondly, if the building is of top quality, meeting or exceeding the code standards, and the guests are reasonably prepared—but the fire department does not arrive quickly, or know what to do—unnecessary deaths will result. Thirdly, if the building is as safe as possible, and the fire department has the best training and equipment available—but the guests panic and jump out of windows—the end result is the same.

As a result of recent hotel fires, emphasis has been placed on stricter building codes, thus improving the safety features for guests—such as less flammable plastics, better fire impedance, more alarms, more sprinklers, etc. Local fire departments are also taking another long hard look at the high-rise building and how to cope with the inevitable fires.

SUMMARY AND OBJECTS OF THE INVENTION

From the above analysis, the applicants have developed a device which will provide emergency lifesaving materials that can be readily located within a given room or suite.

Thus, it is an important object of this invention to provide an emergency fire-safety device that is arranged to be mounted within a given area and be readily accessible to an occupant or occupants, the device being preferably located on the ceiling above the exit door of a room.

It is another object of the invention to provide an emergency fire-safety device defined by a combination smoke detector and one or more air bags that are automatically released fo use as the smoke detector is activated.

Still another object of the present invention is to provide, in combination, a smoke detector and air-bag members, the device comprising one compartment which includes a sensing system activated by smoke—in turn causing a latching device to release a hinged door that covers an additional compartment or compartments for storing the air bags.

A further object of the invention is to provide an apparatus of this character wherein the air bag or bags will automatically drop so as to hang at an accessible level for complete removal from each respective compartment.

A still further object of the invention is to provide an air bag that is readily filled with air when fully opened, and that is formed so as to be positioned over the head and secured about the body, whereby sufficient air within the bag allows one to breathe easily while exiting the building under emergency conditions.

It is a further object of the invention to provide an emergency air bag that will allow one to breathe without fear of inhaling excessive, life-threatening smoke and toxic fumes.

It is still a further object of the invention to provide an apparatus of this character that is simple to service and maintain, and is relatively inexpensive to manufacture.

The characteristics and advantages of the invention are further sufficiently referred to in connection with the accompanying drawings, which represent one embodiment. After considering this example, skilled persons will understand that variations may be made without departing from the principles disclosed; and we contemplate the employment of any structures, arrangements or modes of operation that are properly within the scope of the appended claims.

BRIEF DESCRIPTION OF THE DRAWINGS

Referring more particularly to the accompanying drawings which are for illustrative purposes only, and wherein like parts are indicated by like reference numerals:

FIG. 1 is a pictorial view of the present invention mounted to the ceiling above the exit door of a room, and showing the pair of air bags released from their stored location;

FIG. 2 is a top-plan view of the housing of the present invention, the air bags being shown by dotted lines in their normal stowed position;

FIG. 3 is a view of the apparatus having the cover plate removed from over the smoke-alarm system, the hinged door being shown removed to illustrated the air-bag compartment;

FIGS. 4*a*, 4*b* and 4*c* illustrate the steps of employing a bag so as to hold air for use under emergency conditions; and FIG. 5 is an enlarged, cross-sectional view of the release mechanism for the hinged door taken along line 5—5 of FIG. 2.

DESCRIPTION OF THE PREFERRED EMBODIMENT

Referring more particularly to FIG. 1, there is shown a pictorial view of a corner of a room 10 having an exit door 12. This room represents any typical one found in multistory office and hotel buildings for which the present invention is more specifically designed.

Thus, the present invention, a combination smoke detector and air-containing-bag device, generally indicated at 14, comprises a housing unit 16 having a substantially square or rectangular configuration defined by front wall 18, side walls 20, and rear wall 22. The housing unit 16 is further constructed with a plurality of separate compartments, including a smoke detector compartment 24 and a pair of storage compartments 26.

The smoke-detector compartment is established by the forward portions of side walls 20, front wall 18, and an intermediate wall 28 which is transversely positioned between side walls 20. Smoke-detector compartment 24 is more clearly illustrated in FIG. 3, which also shows the arrangement of the contiguous storage compartments 26. A central partition or wall 30 is positioned between rear wall 22 and intermediate wall 28, the rear portion of side walls 20 completing the structural arrangement of compartments 26.

As seen in FIGS. 1, 2 and 3, the elongated configuration of compartment 24 is defined by a fixed upper panel member 32 and a bottom panel 34, the smoke detector unit (designated at 35) being designed to be mounted in compartment 24. The two storage compartments 26 are covered by a hinge panel 37 having suitable hinge means 38. Accordingly, each storage compartment is adapted to releasably store an air-bag apparatus, generally designated at 40. The air bag which is designed to hold clean air for breathing will hereinafter be described in more detail.

Referring more particularly to the smoke detector 35, there is shown in FIG. 3 a smoke-detector unit 35, which may be any suitable type on the market such as the one manufactured by Pitway Corporation of Aurora, Ill. Generally, a smoke-detector unit comprises a circuit board such as at 42 and shown secured to a bottom panel 34 of housing 16. Mounted to the circuit board 42 is a smoke-detector means 36 which usually contains Americium 241 and 1.0 Microcurie.

When smoke-detector means 36 is activated by smoke in the ambient air, it will in turn activate an alarm which includes a sound-generating means such as a buzzer device 38, and visualindicating means in the form of lights 43 which are located in front wall 18 and panel 32. There is also included a light fixture 44 which is positioned in line with window 46 mounted in fixed panel 32. Light fixture 44 provides enough light for the surrounding area so as to allow one within a room to find the exit door. A limit-time switch 48 is also provided in the cirucit, the switch being used to limit the time during which buzzer 38 is allowed to sound. That is, once the sound means is activated, it will preferably turn itself off within a specific set time—for example, a limit of fifteen minutes. The smoke-detector unit 35 is typically powered by batteries 52. In order for the detector to sense the ambient air, a plurality of vents in the form of elongaged slots 54 are disposed in front wall 18, side walls 20 and panel 32, as illustrated in FIGS. 1 and 2.

Referring now to the releasably hinged door or panel 37, there is shown in FIGS. 3 and 5 a latch means (generally indicated at 55) comprising a solenoid 58 which is wired to the smoke-detector circuit (not shown), whereby the solenoid is activated at the same time the buzzer sounds. The solenoid is so positioned as to provide a latch arrangement for the hinged door or panel 37. FIG. 5 illustrates the solenoid 58 mounted to fixed panel 32. When in a latched position, the solenoid pin 60 passes through hole 62 formed in intermediate wall 28, and it extends into one of the compartments 26. Door 37 is provided with a latch hook 64 which is positioned to engage pin 60. Hence, when the solenoid is activated, pin 60 retracts and disengages latch hook 64—thus permitting door 37 to open by gravity, as illustrated in FIG. 1. When door 37 is released, the air-breathing bags 40 stored in compartments 26 are allowed to drop freely and hang in front of the exit door 12, the light from the fixture 44 illuminating them.

Each air-breathing bag 40 is formed from a sheet of suitable plastic material that is formed as a bag 65 so as to define an air chamber 63. The opening 66 is formed along one of the longitudinal edges, the peripheral edge of opening 66 being provided with a sealing means defined by a continuous strip of an elastic band 68 which allows opening 66 to be enlarged when positioned over the user, as illustrated in FIGS. 4*a* and 4*b*. FIG. 4*c* illustrates the air bag engaging the wearer's body in such a manner as to seal off the ambient air in order to prevent smoke and/or gases from entering the air chamber thus formed.

Tie-down straps 70 are attached to the opposite edges of opening 66. These straps are used for two purposes, one being as a means for securing the bag over the individual's head and upper body. The other purpose is to use the straps as tether lines when the bags are released from compartments 26. When stored, each bag is appropriately folded in its respective compartment with the straps wrapped about the bags, as shown in FIG. 3. One of the straps of each bag is provided with an attaching means 71 Accordingly, as the hinge panel 37 is released by latch means 55, the bags drop as seen in FIG. 1, while one of the straps is still attached to each compartment. This allows the two bags to hang from the ceiling at a sufficient distance so as to readily allow pulling the straps to free the bags for use.

A bag is then unfolded and opened wide to allow air to be scooped therein, as illustrated in FIG. 4*a*. FIG. 4*b* also shows how the bag is then placed over the user's head and pulled inwardly, as indicated by arrow 75. The two straps 70 are wrapped about the waist and tied as shown in FIG. 4*c*. Thus, enough clean air is encapsulated in the bag to allow one to escape to safety through a smoke-filled building. The elastic edging 68 forms a sufficient seal to prevent smoke or toxid gases from entering the bag's air chamber while the user is fleeing.

After use, the bags can be simply unfolded with the straps in place about them. The attaching ends for the bags are then again secured in their respective compartments and the bags are positioned therein. Finally, the hinged panel 37 is latched into a closed position and the entire apparatus resumes its stored mode.

The invention and is attendant advantages will be understood from the foregoing description, and it will be apparent that various changes may be made in the form, construction and arrangement of the parts of the invention without departing from the spirit and scope thereof or sacrificing its material advantages, the arrangement hereinbefore described being merely by way of example; and we do not wish to be restricted to the specific form shown or uses mentioned, except as defined in the accompanying claims.

We claim:

1. A smoke detector in combination with a bag for containing ambient air, comprising:

a housing adapted to be mounted to a ceiling or a wall of a room adjacent the exit door;

a smoke-detector unit mounted within said housing to detect smoke within said room;

said housing having at least one storage compartment;

a hinged panel covering said storage compartment;

an air bag folded and stored in said storage compartment; and releasable latching means adapted to release said hinged panel to an open position, whereby said air bag for containing ambient air is freed from said storage chamber when said smoke detector is activated;

wherein said bag defines an air chamber having an opening therein, whereby the head of the wearer is received in said chamber, and wherein said air bag includes means for securing said bag to said wearer's body;

wherein said securing means comprises a pair of tie-down straps secured at one end to opposite sides of said air bag, the free ends thereof being tied about the body of said wearer when in use;

and wherein said air bag includes means for attaching one of said tie-down straps to said storage compartment, so as to allow said bag to drop down and hang from said storage compartment, wherein the wearer thereof can remove said bag from said housing.

2. The combination as recited in claim 1, wherein said attaching means comprises:

a first attaching member secured to the inside of said storage compartment; and a second corresponding attaching member secured to said free end of one of said tie-down straps, whereby said first and second attaching member means are adapted to be coupled together and released when said wearer is to use said bag.

3. The combination as recited in claim 2, wherein the peripheral edge of said opening of said air bag is formed with a sealing means secured thereto, whereby said opening of said air bag will fit closely over the body of said wearer, thus preventing smoke and/or toxic fumes from entering said air chamber.

4. The combination as recited in claim 3, wherein said sealing means comprises a continuous strip of an elastic band.

5. The combination as recited in claim 4, wherein said smoke-detector unit includes:

a smoke-sensing means;

a sound-generating means operably connected to said smoke-sensing means;

a visual indicating means operably connected to said smoke-sensing means;

said sound-generating means and said visual-indicating means being activated by said smoke-sensing means; and a power source interconnected to said smoke-sensing means and said visual-indicating means.

6. The combination as recited in claim 5, wherein said smoke-detector unit includes a time-limit means, whereby said sound-generating means is shut off at a preselected time.

7. The combination as recited in claim 6, wherein said smoke-detector unit includes a light fixture.

8. The combination as recited in claim 7, wherein said releasable latching means comprises:

a solenoid mounted in said housing and having a latch pin; and a latch hook mounted to said hinged panel for engagement with said latch pin of said solenoid;

said solenoid being activated by said smoke-sensing means, whereby said hinged panel is released to an open position so as to permit said air bag to drop freely from said storage compartment.

9. The combination as recited in claim 8, wherein said housing is formed with two contiguous storage compartments and two air bags, said air bags being stored in corresponding compartments for simultaneous release.

* * * * *